United States Patent [19]

Couper

[11] Patent Number: 4,765,851

[45] Date of Patent: Aug. 23, 1988

[54] ALUMINUM ALLOY FOR THE PREPARATION OF POWDERS HAVING INCREASED HIGH-TEMPERATURE STRENGTH

[75] Inventor: Malcolm J. Couper, Ennetbaden, Switzerland

[73] Assignee: BBC Brown, Boveri & Company, Limited, Baden, Switzerland

[21] Appl. No.: 875,733

[22] Filed: Jun. 18, 1986

[30] Foreign Application Priority Data

Jun. 26, 1985 [CH] Switzerland ..... 2713/85

[51] Int. Cl.[4] ..... C22C 21/00

[52] U.S. Cl. ..... 148/437; 420/550; 420/551; 420/552; 420/553

[58] Field of Search ..... 420/550, 551, 552, 553; 148/437

[56] References Cited

FOREIGN PATENT DOCUMENTS 216204 11/1941 Switzerland .

OTHER PUBLICATIONS

Corrosion Science, Band. 22, Nr. 4, P. Niskanen et al.: "Corrosion of Aluminium Alloys Containing Lithium", Seiten 283-304, Siehe Seiten 283-285, 1982.

*Primary Examiner*—R. Dean

*Attorney, Agent, or Firm*—Oblon, Fisher, Spivak, McClelland & Maier

[57] ABSTRACT

An aluminum alloy for the production of powders having increased high-temperature strength by rapid quenching, the said alloy containing 1.5 to 5% by weight of Li, 4 to 11% by weight of Fe and 1 to 6% by weight of at least one of the elements Mo, V or Zr, the remainder being Al, or 1.5 to 5% by weight of Li, 4 to 7% by weight of Cr and 1 to 4% by weight of at least one of the elements V or Mn, the remainder being Al. A low density and good high-temperature strength as well as good thermal stability up to 400° C. coupled with Vickers hardnesses of up to 180 (HV) are achieved. Hardness-imparting dispersoids in the form of the phases $Al_3Li$ and $Al_3Zr$, as well as other intermetallic compounds of Al with Mo, V or Mn, having a particle diameter of no more than 0.1 μm, constitute a large volume fraction.

7 Claims, No Drawings

ALUMINUM ALLOY FOR THE PREPARATION OF POWDERS HAVING INCREASED HIGH-TEMPERATURE STRENGTH

The invention relates to an aluminum alloy for the production of powders having increased high-temperature strength, of the class defined in the preamble of claim 1.

It is known from powder metallurgy that the properties of compression-molded and sintered or hot-pressed articles consisting of aluminum alloys are substantially determined by the properties of the powder used. In addition to a chemical composition, the particle size and microstructure play an important role. The two last-mentioned properties in turn depend substantially on the cooling rate. This should be as high as possible. Various processes and material compositions have been proposed for achieving greater high-temperature strengths in articles made of an aluminum alloy. By means of high cooling rates, segregation is avoided and the solubility limit for alloy elements is increased, so that, by a suitable heat treatment or thermomechanical treatment, finer precipitates having higher strengths can be obtained. It is also possible to form advantageous metastable phases which cannot be established under conventional quenching conditions. Other advantageous properties which can be obtained by high cooling rates are increased corrosion resistance and better toughness of the alloys.

In general, by using heavy metals as alloy components, the density and other physical properties are influenced in an adverse manner. Hence, the use of the element lithium as an essential alloy component in the course of the conventional production was proposed some time ago, especially for applications in aircraft construction. This makes it possible to reduce the density of the alloy but to increase its modulus of elasticity, which is advantageous with regard to its use as a construction material (cf. E. S. Balmuth & R. Schmidt, 1981, "A Perspective on the Development of Aluminum-Lithium Alloys", Proceedings of the 1st Int. Aluminum-Lithium Conf., ed. T. H. Sanders and E. A. Starke, Jr., pages 69–88). However, alloys of this type lack the toughness and ductility required for many purposes. This problem has been discussed in detail and has led to alloys with further additives (cf. E. A. Starke, T. H. Sanders, Jr. & I. G. Palmer, 1981, "New Approaches to Alloy Development in the Al-Li System", J. of Metals, 33, No. 9, pages 24–32). Further alloy systems have been developed to meet specific requirements (cf. F. W. Gayle & J. B. Vander Sande, 1984, "Composite Precipitates in an Al-Li-Zr Alloy", Scripta Met., 18, pages 473–478; B. Noble, S. J. Harris & K. Harlow, 1984, "Mechanical Properties of Al-Li-Mg Alloys at Elevated Temperature", Proc. 2nd Int. Aluminum-Lithium Conference, ed. T. H. Sanders & E. A. Starke, pages 65–78; I. G. Palmer et al., 1984, "Effect of Processing Variables on Two Al-Li-Cu-Mg-Zr Alloys" ibid, pages 91–100).

Although noteworthy results, in particular increased high-temperature strength in the temperature range from 250 to 300° C., have been achieved to date, the properties of the workpieces proposed to date and produced by powder metallurgy are still unsatisfactory. This applies in particular to the high-temperature strength, the ductility and the fatigue strength in the temperature range from room temperature to about 250° C. Moreover, these alloys generally have densities which are about 10% higher than those of conventional aluminum alloys. On the other hand, low-density alloys possess virtually no high-temperature strength.

There is therefore a great need for alloys which have been further improved, for the production of suitable powders, in particular those having a low density.

It is the object of the invention to provide aluminum alloys which are suitable for the production of powders having increased high-temperature strengths and improved mechanical and structural properties coupled with a low density. It is desired in particular to obtain compositions which, under the proposed quenching conditions, form stable intermetallic compounds which act as fine dispersoids.

This object is achieved by the features stated in the characterizing clause of claim 1.

The invention is described with reference to the embodiments below.

EMBODIMENT 1

An alloy having the following nominal composition was prepared:

Li=2.0% by weight
Fe=8.5% by weight
Zr=1.0% by weight
Al=remainder.

The alloy was obtained by melting appropriate amounts of master alloys containing 10% by weight of Li, 10% by weight of Fe and 5% by weight of Zr. These aluminum master alloys were melted in an alumina crucible in an induction furnace in vacuo, and the melt was poured directly into a copper ingot mold. The total weight of the ingot was 1 kg. 300 g of this ingot were inductively melted in an apparatus and spun in the form of a jet under high pressure in the first gas phase against the periphery of a cooled copper disk rotating at a peripheral speed of 10 m/s (so-called "melt spinning" method). As a result of the high cooling rate, an ultra-fine-particled ribbon about 40 μm thick was produced. The ribbon was crushed, and milled to give a fine-particled powder. A cylindrical capsule made of ductile aluminum sheet and having a diameter of 50 mm and a height of 60 mm was then filled with the powder, evacuated and welded. The filled capsule was then hot-pressed at 400° C. under a pressure of 250 MPa, to the full theoretical density. The capsule was removed by mechanical processing, and the compression-molded specimen was used as a slug of 36 mm diameter in an extruder having a reduction ratio of 30:1, and extruded at 400° C. to give a rod of 6.5 mm diameter.

Specimens were produced from the rod, in order to investigate the physical and mechanical properties. A specimen was subjected to a heat treatment at 400° C. for 2 hours. The Vickers hardness determined thereafter at room temperature was 180 (HV). The tensile strength and yield point was found throughout to be 50 to 80% higher than those of comparable conventional alloys, while the density was only 2.85 g/cm$^3$.

EMBODIMENT 2

The following alloy was prepared by melting, according to Example 1:

Li=2.5% by weight
Fe=8.0% by weight
Mo=1.0% by weight
Al=remainder.

Successive processing to a ribbon, to a powder and to an extruded rod was carried out exactly as described in Example 1. The initial Vickers hardness at room temperature was 200 (HV), while the Vickers hardness after a heat treatment at 400° C. for 2 hours was still 180 (HV). This shows that excellent thermal stability has been achieved, which is indicative of good high-temperature strength.

EMBODIMENT 3

An alloy having the following nominal composition was prepared:

Li=3.0% by weight
Cr=5.5% by weight
Zr=1.0% by weight
Al=remainder.

The alloy was prepared by melting appropriate Al/Li, Al/Cr and Al/Zr master alloys, and was cast to give an ingot similarly to Example 1. The ingot was melted again and brought to a casting temperature of 1100° C. The melt was then atomized under an inert gas atmosphere under a pressure of 6 MPa to give a powder having an average particle diameter of 30 μm. The powder produced in this manner was introduced into an aluminum can, which was then evacuated and sealed vacuum-tight. The specimen was compacted and hot-pressed similarly to Example 1. After the part of the can which forms the shell had been turned off, the compression-molded specimen was heated to a temperature of 450° C. and extruded at this temperature, with a reduction ratio of 30:1, to give a round rod. The entire procedure for processing the powder was carried out under a protective gas atmosphere.

Samples produced from the rod were found to have a density of 2.80 g/cm$^3$. After a heat treatment at 400° C. for 2 hours, the Vickers hardness at room temperature was 170 (HV), while after a further heat treatment at the same temperature for an additional 50 hours, it was still 160 (HV). This indicates high thermal stability of the structure. The improvement in the strengths over conventional alloys of the same density was about 100%.

The invention is not restricted to the embodiments. In principle, the aluminum alloy can consist of 1.5 to 5% by weight of Li, 4 to 11% by weight of Fe and 1 to 6% by weight of at least one of the elements Mo, V or Zr, the remainder being Al, or of 1.5 to 5% by weight of Li, 4 to 7% by weight of Cr and 1 to 4% by weight of at least one of the elements V, Mn or Zr, the remainder being Al.

Preferred aluminum alloys contain: 1.5 to 4.5% by weight of Li, 5 to 10% by weight of Fe and at least one of the elements Mo, V or Zr in a maximum content of 2% by weight each, the total content of these 3 last-mentioned elements not exceeding 4% by weight; or: 1.5 to 4.5% by weight of Li, 4 to 7% by weight of Fe and at least one of the elements Mn, Zr or Mo in a maximum content of 2% by weight each, the total content of these 3 last-mentioned elements not exceeding 4% by weight.

The aluminum alloys have a relatively large volume fraction of phases—in particular intermetallic compounds—which cannot be produced by conventional preparation methods. These particles, which act as dispersoids, are mainly responsible for the outstanding properties of the alloys. In the present case, at least 15% by weight of the phase $Al_3Li$ and at least 2.6% by weight of the phase $Al_3Zr$ or of another intermetallic compound of aluminum with Mo, V or Mn should be present in the alloy as a finely divided dispersoid having a particle diameter of no more than 0.1 μm.

I claim:

1. An aluminum alloy for the production of a powder having increased high-temperature strength, which alloy consists of 1.5 to 5% by weight of Li, 4 to 11% by weight of Fe and 1 to 6% by weight of at least one of the elements Mo, V or Zr, the remainder being Al, or of 1.5 to 5% by weight of Li, 4 to 7% by weight of Cr and 1 to 4% by weight of at least one of the elements V, Mn or Zr, the remainder being Al, which alloy contains the phase $Al_3Li$ and the phase of an intermetallic compound of Al with Mo, V, Zr or Mn as a finely divided dispersoid having a particle diameter of no more than 0.1 μm.

2. An aluminum alloy as claimed in claim 1, which contains 1.5 to 4.5% by weight of Li, 5 to 10% by weight of Fe and at least one of the elements Mo, V or Zr in a maximum content of 2% by weight each, the total content of these 3 last-mentioned elements not exceeding 4% by weight, which alloy contains the phase $Al_3Li$ and the phase of an intermetallic compound of Al with Mo, V or Zr as a finely divided dispersoid having a particle diameter of no more than 0.1 μm.

3. An aluminum alloy as claimed in claim 2, which contains 2% by weight of Li, 8.5% by weight of Fe and 1% by weight of Zr.

4. An aluminum alloy as claimed in claim 2, which contains 2.5% by weight of Li, 8% by weight of Fe and 1% by weight of Mo.

5. An aluminum alloy for the production of a powder having increased high-temperature strength, which alloy consists of 1.5 to 4.5% by weight of Li, 4 to 7% by weight of Fe and at least one of the elements Mn, Zr or Mo in a maximum content of 2% by weight each, the total content of these 3 last-mentioned elements not exceeding 4% by weight, the remainder being Al, which alloy contains the phase $Al_3Li$ and the phase of an intermetallic compound of Al with Mn, Zr or Mo as a finely divided dispersoid having a particle diameter of no more than 0.1 μm.

6. An aluminum alloy as claimed in claim 1, which contains 3% by weight of Li, 5.5% by weight of Cr and 1% by weight of Zr.

7. An aluminum alloy as claimed in claim 1, which contains at least 15% by weight of the phase $Al_3Li$ and at least 2.6% by weight of the phase $Al_3Zr$ or of other intermetallic compounds of Al with Mo, V or Mn as a finely divided dispersoid having a particle diameter of no more than 0.1 μm.

* * * * *